US007762493B2

(12) United States Patent
Berberet et al.

(10) Patent No.: US 7,762,493 B2
(45) Date of Patent: Jul. 27, 2010

(54) CONSUMABLE PAPER ROLL HOLDER

(75) Inventors: Suzanne M. Berberet, St. Joseph, MI (US); Cary Dean Edmonds, Plymouth, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 12/123,312

(22) Filed: May 19, 2008

(65) Prior Publication Data

US 2009/0283624 A1 Nov. 19, 2009

(51) Int. Cl.
*B65H 75/18* (2006.01)

(52) U.S. Cl. ..... 242/598.2; 242/598.4; 242/598.5

(58) Field of Classification Search ..... 242/597, 242/597.1, 597.8, 598, 598.1, 598.2, 598.3, 242/598.4, 598.5
See application file for complete search history.

(56) References Cited

U.S. PATENT DOCUMENTS 497,005 A * 5/1893 Jerome ..... 242/423
810,606 A 1/1906 Ball
873,188 A 12/1907 Thumann
1,182,523 A * 5/1916 Benson ..... 242/129.6
1,665,738 A 4/1928 Hoegger
1,665,739 A 4/1928 Hoegger
1,778,856 A 10/1930 Hoegger
1,889,024 A * 11/1932 Marsh ..... 242/598.1
2,466,957 A 4/1949 Lewis
2,517,809 A 8/1950 Tarzian
3,022,957 A 2/1962 Blunt et al.
3,138,340 A 6/1964 Caravella
3,157,370 A 11/1964 Govatsos et al.
3,295,777 A 1/1967 Carroll
3,586,252 A 6/1971 Sutton
4,381,083 A 4/1983 Tsunetsugu
4,416,425 A 11/1983 Kish
4,741,486 A 5/1988 Ancona et al.
4,775,109 A 10/1988 Tegg
4,824,038 A 4/1989 Chandler
4,836,462 A 6/1989 Bruss
4,871,123 A * 10/1989 Lee ..... 242/592
D317,386 S 6/1991 McKeone
5,149,003 A 9/1992 Tharp
5,222,678 A 6/1993 Carrington
5,450,981 A 9/1995 Fields
5,718,396 A 2/1998 Maresca
5,765,775 A 6/1998 Keserica
5,782,428 A 7/1998 Chabot
5,868,344 A 2/1999 Melnick
5,871,170 A 2/1999 Morales et al.
5,913,491 A 6/1999 Bulla (Continued)

OTHER PUBLICATIONS

Kingsley Technical Specification, Paper holder YB5408 (2006).

(Continued)

*Primary Examiner*—William A Rivera
(74) *Attorney, Agent, or Firm*—Quarles & Brady LLP

(57) ABSTRACT

A consumable roller holder is disclosed that provides a pair of arms extending from an essentially centrally located mount. A spindle is coupled to one of the arms for supporting a consumable roll and one of the arms is configured to pivot between a closed position and an opened position at which the arm is self-supporting to resist rotation of the arm toward the closed position.

20 Claims, 5 Drawing Sheets

U.S. PATENT DOCUMENTS

| | | | |
|---|---|---|---|
| 6,007,019 | A | 12/1999 | Lynch |
| 6,199,791 | B1 | 3/2001 | Conran et al. |
| 6,328,253 | B1 | 12/2001 | Paul |
| 2002/0020780 | A1 | 2/2002 | Otsuji |
| 2006/0261211 | A1 | 11/2006 | Hass |
| 2007/0158491 | A1 | 7/2007 | Moore |

OTHER PUBLICATIONS

Moen, Kingsley Paper Holder, Model # YB5408CH, www.moen.com/products/YB5408CH.

Creative Specialties International, a division of Moen, Innovative Pivoting Collection, http://csi.moen.com/newproducts/pivotingCollections.cfm.

Creative Specialties International, a division of Moen, Pivoting Paper Holders, http://csi.moen.com/newproducts/pivot.cfm.

Moen Press Release (Feb. 11, 2004), "Creative Specialties International's Pivoting Paper Holder Now in Five Collections,"www.moen.com/Consumer/press/Article.cfm?ArticleID=608.

* cited by examiner

CONSUMABLE PAPER ROLL HOLDER

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to roll holders, and in particular, to an essentially symmetric consumable paper roll holder having a moveable arm that is self-supporting in the opened position.

Replacing a consumable paper roll, such as a toilet paper roll or a paper towel roll, in most cases is a two-hand job that often results in dropping the replacement roll at least once while trying to remove the used roll and insert the new roll.

Many roll holders incorporate a spring-loaded spindle to secure the roll to the holder during use. This too creates difficulties when attempting to compress the spindle to re-seat the spindle into the holder. Cramped quarters and tight clearances make it difficult, even when using two hands, to replace a spent roll. The difficulties and frustrations are exacerbated for those having physical handicaps that reduce the level of fine motor control required to manipulate a multi-piece, spring-loaded holder.

Several attempts have been made to reduce the burden of replacing a depleted roll. For example, U.S. Pat. No. 873,188 describes a roll holder having an offset wall mount that supports both a fixed support arm and a pivoting arm. A spindle extends through the fixed support arm and supports a roll. The free end of the spindle is then selectively closed off by an end piece on the pivoting arm.

This construction has several drawbacks. First, the cantilevered mounting of both the pivoting arm and the spindle to the fixed support arm results in a large moment being applied to the fixed support arm. Over time, this moment will cause the fixed support arm to rotate, and thus the whole roll holder will acquire a slanted appearance, or at a minimum, place additional stress on the mounting screws. Second, once in the opened position, the moveable arm must be manually held in place while the replacement roll is slid over the spindle. Third, in addition to lacking robustness, the non-weight balanced design is aesthetically displeasing.

Other attempts have incorporated a vertically hinged side plate (e.g., U.S. Pat. No. 4,381,083), required that the spindle assembly swivel outward or upward from a single mounting post (e.g., U.S. Pat. Nos. 1,665,738 and 2,517,809), or required rather cumbersome and bulky joints.

Thus, a need exists for an improved consumable roll holder having a weight-balanced structure with a moveable arm that allows for quick and easy roll replacement.

SUMMARY OF THE INVENTION

In one aspect the present invention provides a consumable roll holder including a surface mount and a support arm having a proximal end and a distal end with the proximal end being coupled to the surface mount. The holder also includes a spindle having a first end and a second end, wherein the first end of the spindle is coupled to the distal end of the support arm. The roll holder further includes a pivot arm having a proximal end and a distal end, with the proximal end being pivotally coupled to the surface mount. The distance from the proximal end to the distal end of the support arm is essentially equal to the distance from the proximal end to the distal end of the pivot arm.

In another aspect, the invention provides a consumable roll holder mountable to a surface, including an escutcheon adjacent the surface, and a surface mount extending from the escutcheon and having a mount head. The holder also includes a support arm having a proximal end and a distal end, with the proximal end being coupled to the mount head. A pivot arm has a proximal end and a distal end, wherein the proximal end is pivotally coupled to the mount head to be rotatable between a closed position and an opened position. The roll holder further includes a spindle having a first end and a second end defining a spindle axis, wherein the first end of the spindle is coupled to the distal end of the support arm or the pivot arm. The support arm and the pivot arm are substantially symmetric about a plane passing through the mount head and substantially perpendicular to the spindle axis.

In yet a further aspect, the invention provides a consumable roll holder having a surface mount and a support arm extending from the surface mount. A spindle extends proximate a distal end of the support arm and defines a spindle axis. A pivot arm extends from the surface mount and is pivotally coupled to the surface mount such that the pivot arm can rotate between a closed position whereat the pivot arm is proximate the spindle and an opened position whereat the pivot arm is spaced apart from the spindle. The support arm and the pivot arm are essentially symmetric about a plane passing through the surface mount and substantially perpendicular to the spindle axis.

These and still other advantages of the present invention will be apparent from the detailed description and drawings. What follows is merely a preferred embodiment of the present invention. To assess the full scope of the invention the claims should be referenced.

DETAILED DESCRIPTION OF THE PREFERRED EMBODIMENTS

The present invention is described with reference to a consumable toilet paper roll holder; however, the invention is equally applicable to other types of consumable roll holders, for example, a paper towel roll holder used in a kitchen or a shop towel roll holder found in a garage.

Figure 1:
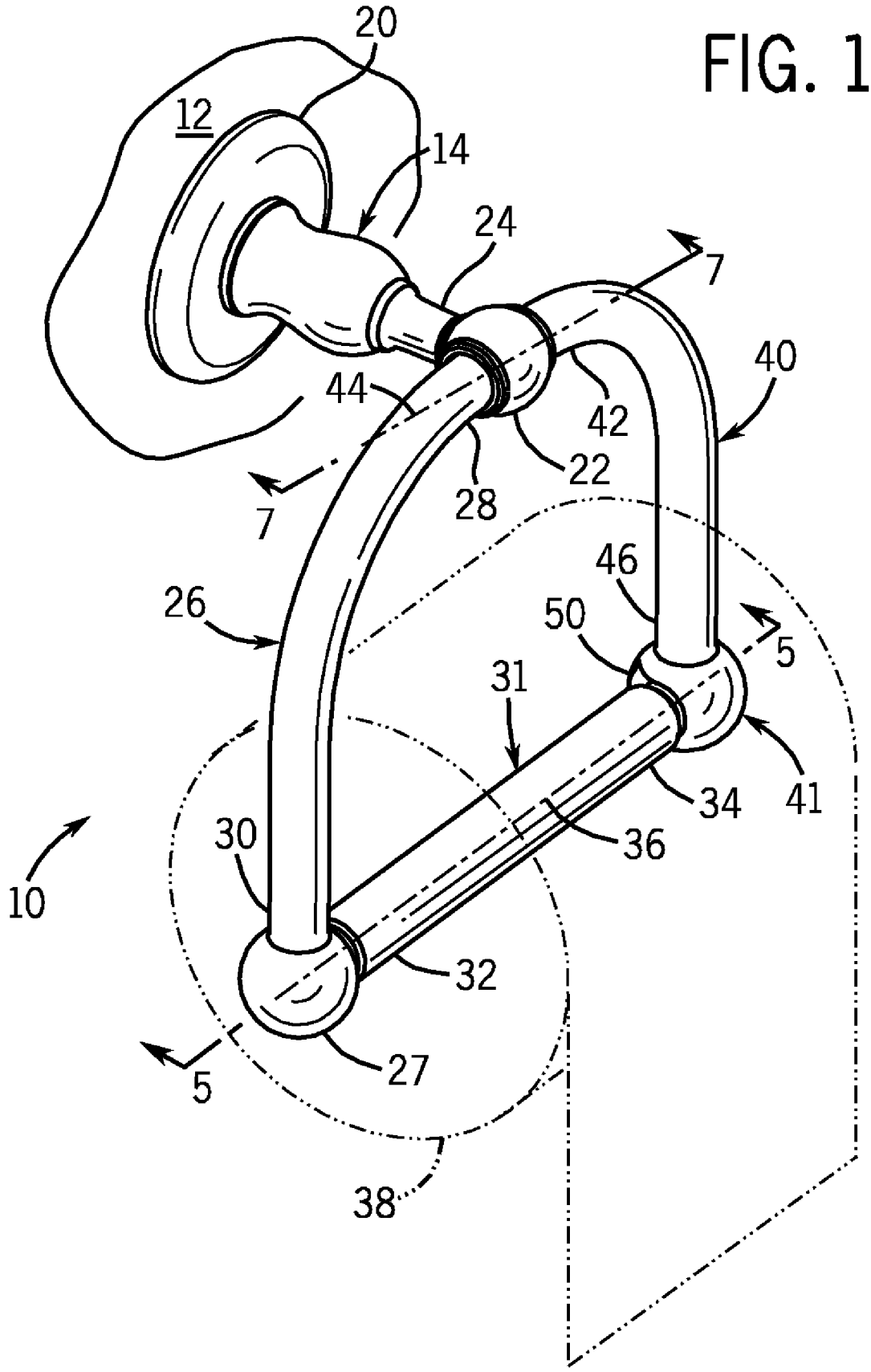
FIG. 1 is a front isometric view of a consumable paper roll holder in accordance with the present invention.

A roll holder 10 in accordance with one aspect of the invention is shown in FIG. 1 mounted adjacent a mounting surface or wall 12. A surface mount 14 is secured to the wall 12 by any technique known to those in the art. For example, the surface mount 14 may include a mounting plate 16 (shown in FIG. 2) that is screwed, bolted, adhered, or the like to the wall 12 and coupled to the balance of the surface mount 14 with a set screw 18 (shown in FIG. 4). In the example embodiment, an escutcheon 20 surrounds the surface mount 14 adjacent the wall 12 to provide an aesthetically pleasing transition from the wall 12 to the surface mount 14. One skilled in the art will appreciate the variety of escutcheons 20 and ways available to mount the surface mount 14 to the wall 12.

A spherical mount head 22 is positioned proximate the distal end 24 of the surface mount 14 and may be integrally formed with the surface mount 14, or may alternatively comprise a separate component of the roll holder 10. A support arm 26 includes a proximal end 28 that is securely coupled to or integrally formed with the mount head 22. A distal end 30 of the support arm 26 extends outward and downward (as shown in FIG. 1) from the substantially central mount head 22 and surface mount 14. The distal end 30 of the support arm 26 terminates in a support head 27 that is securely coupled or integrally formed with a first end 32 of a spindle 31.

Figure 4:
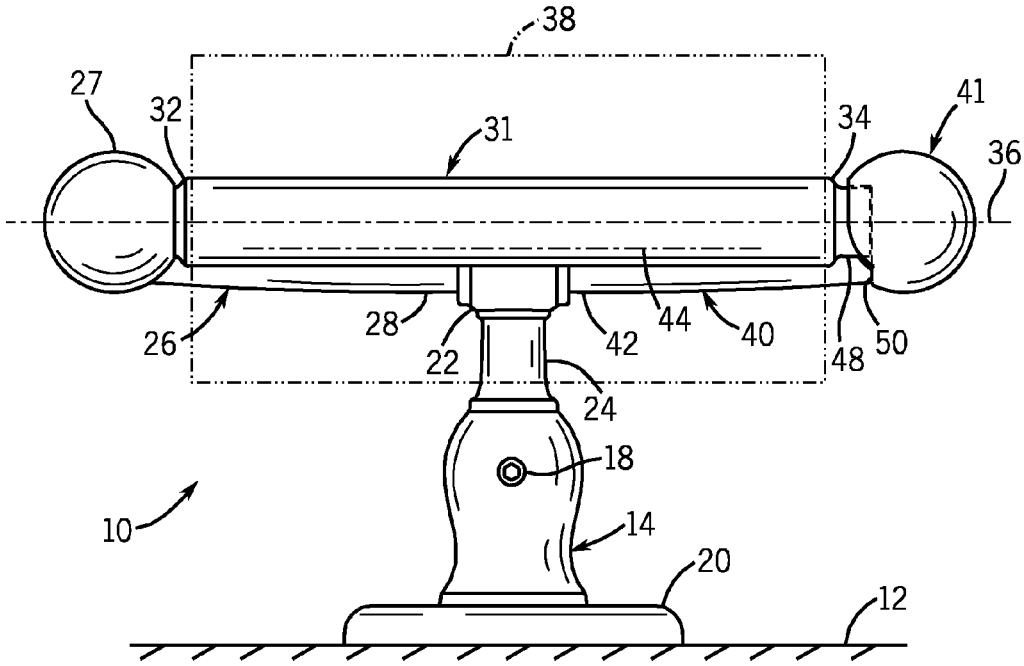
FIG. 4 is a bottom view of the roll holder of FIG. 1 in the closed position.
Figure 5:
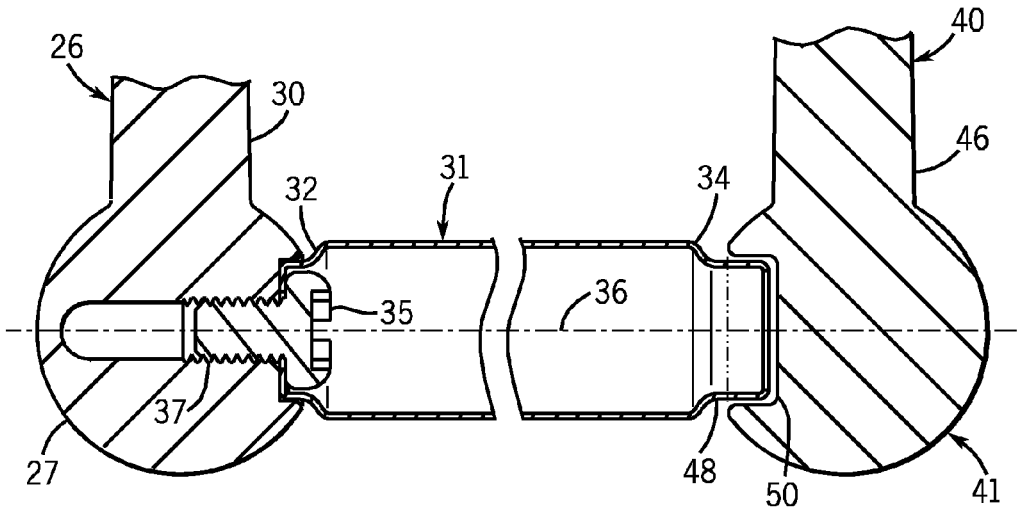
FIG. 5 is a partial section view along line 5-5 of FIG. 1.

As shown in FIG. 5, the example embodiment includes a spindle 31 that is secured to the support head 27 with a fastener 35 that engages a threaded hole 37 formed in the support head 27. In yet another alternative construction, the spindle 31 may be rotatably coupled to the distal end 30 of the support arm 26 to reduce the rotational resistance between the spindle 31 and the consumable roll 38 (shown as dashed lines in FIGS. 1 and 4).

The spindle 31 is substantially straight between the first end 32 and a second end 34 and defines a spindle axis 36 between the first end 32 and the second end 34. Alternatively, the spindle 31 may be bowed, arced, oval, and the like. In any event, the spindle 31 is preferably sized to accommodate the consumable roll 38 used in the particular application.

Returning to the mount head 22, a pivot arm 40 includes a proximal end 42 that is preferably pivotally coupled to the mount head 22 to allow the pivot arm 40 to rotate or pivot about the pivot axis 44. As best shown in FIG. 4, the pivot axis 44 is preferably substantially parallel to the spindle axis 36; however, the pivot axis 44 may be skewed with respect to the spindle axis 36. Moreover, the pivot axis 44 and/or the spindle axis 36 may be skewed with respect to the wall 12.

The distal end 46 of the pivot arm 40 terminates in a pivot head 41. The pivot head 41 captures the second end 34 of the spindle 31 when in the closed or lowered position shown in FIG. 1. With additional reference to FIG. 2, the spindle 31 preferably includes a necked portion 48 that is captured in a pocket 50 formed in the pivot head 41 when the pivot arm 40 is in the lowered position (shown in dashed lines in FIG. 2). One skilled in the art will appreciate the variety of constructions available to capture the consumable roll 38 on the spindle 31.

Figure 2:
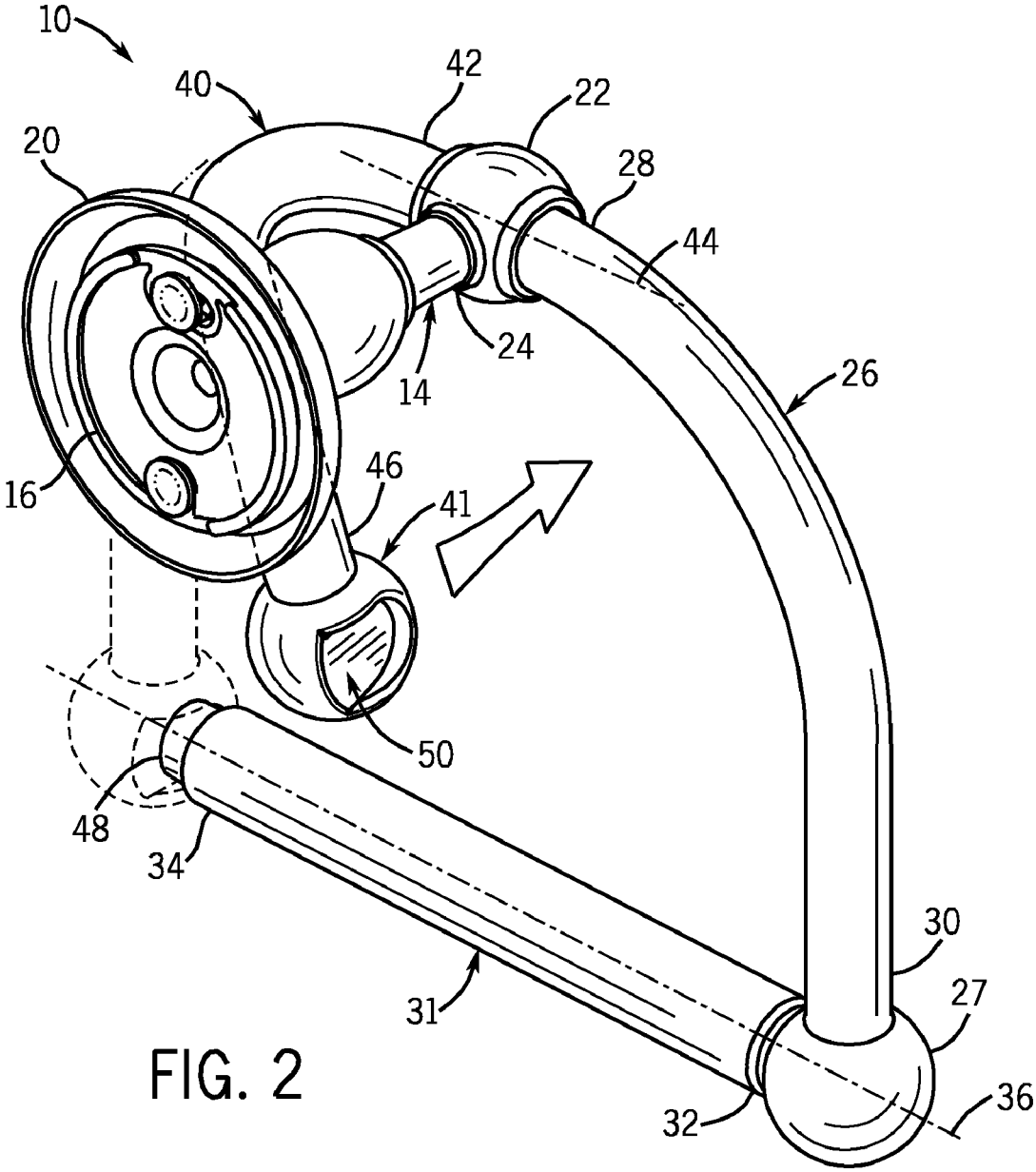
FIG. 2 is a rear isometric view of the roll holder of FIG. 1 showing the pivot arm pivoting from the closed position toward the open position.
Figure 3:
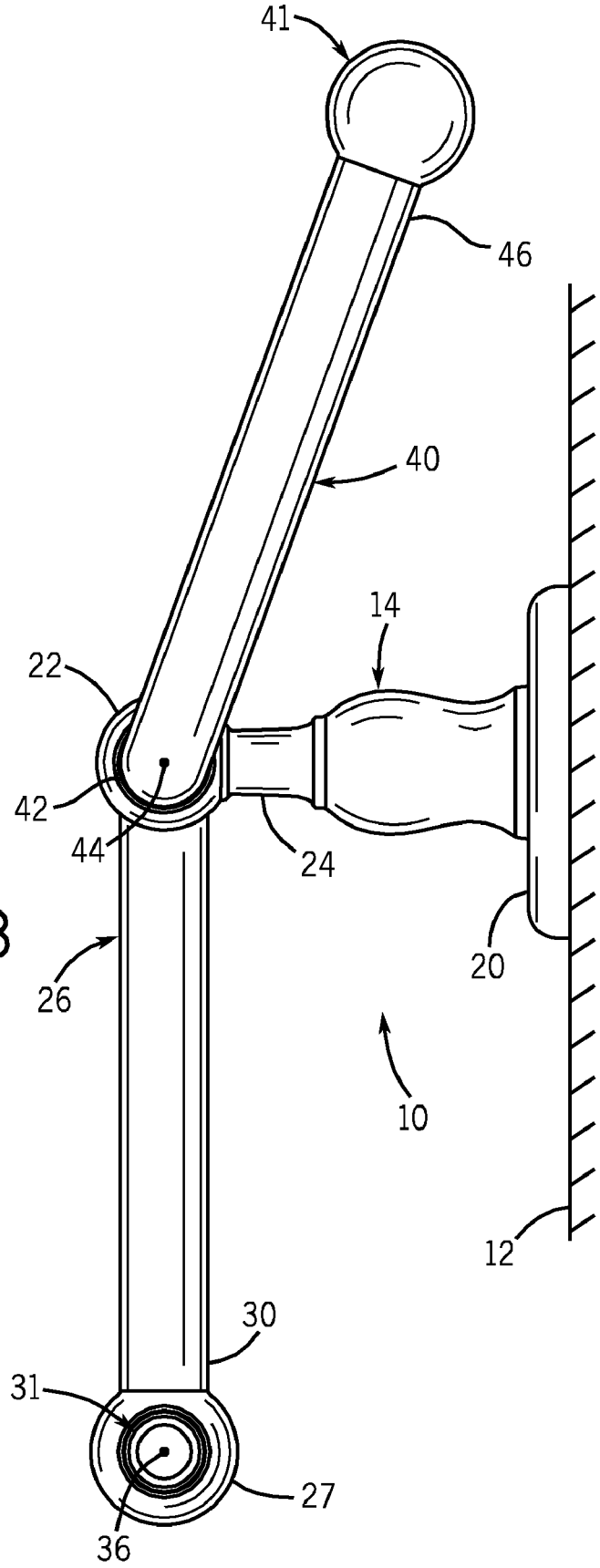
FIG. 3 is a side elevation view of the roll holder of FIG. 1 in the open position.

The pivot arm 40 is moveable or pivotable between the closed or lowered position, shown in FIGS. 1 and 4, to the open or raised position, shown in FIG. 3. To raise the pivot arm 40, a user urges the pivot arm 40 as shown by arrow F in FIG. 2. The pivot arm 40 is preferably configured to rotate about the substantially horizontal pivot axis 44 to the open position shown in FIG. 3. The surface mount 14 is preferably sized to allow the pivot arm 40 to rotate past vertical in the raised position toward the wall 12, helping to maintain the pivot arm 40 in the open position.

With the pivot arm 40 in the raised position, the spent consumable roll 38 can be easily slid from the spindle 31 and a new consumable roll 38 installed. As a result, the replacement of the consumable roll 38 may be accomplished with a single hand.

Figure 6:
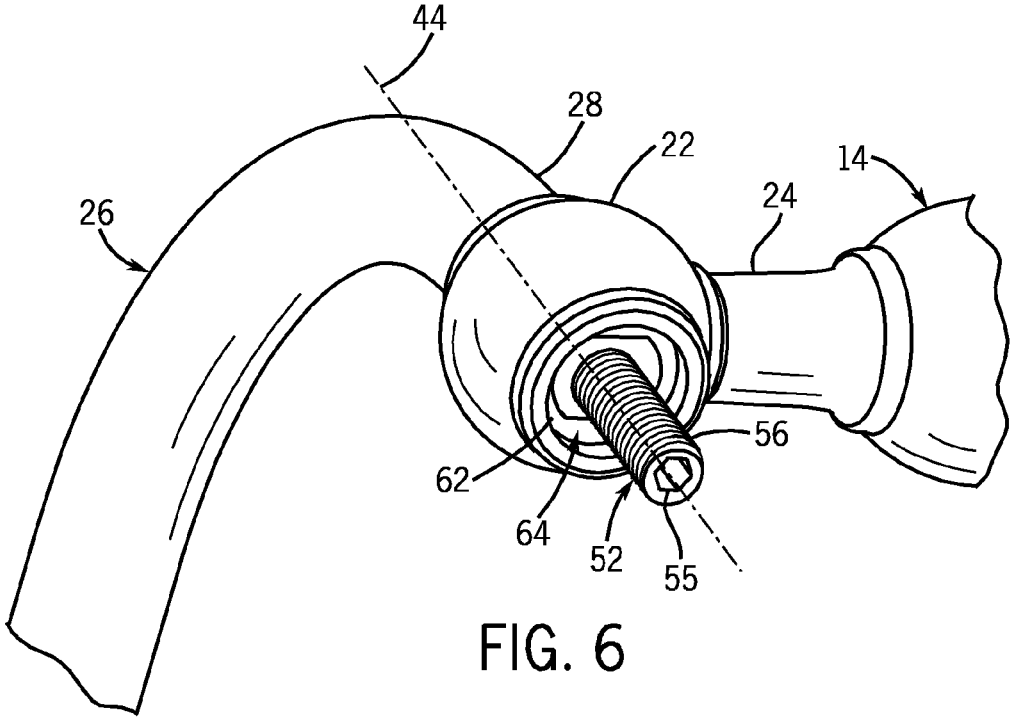
FIG. 6 is an isometric view with the pivot arm removed.
Figure 7:
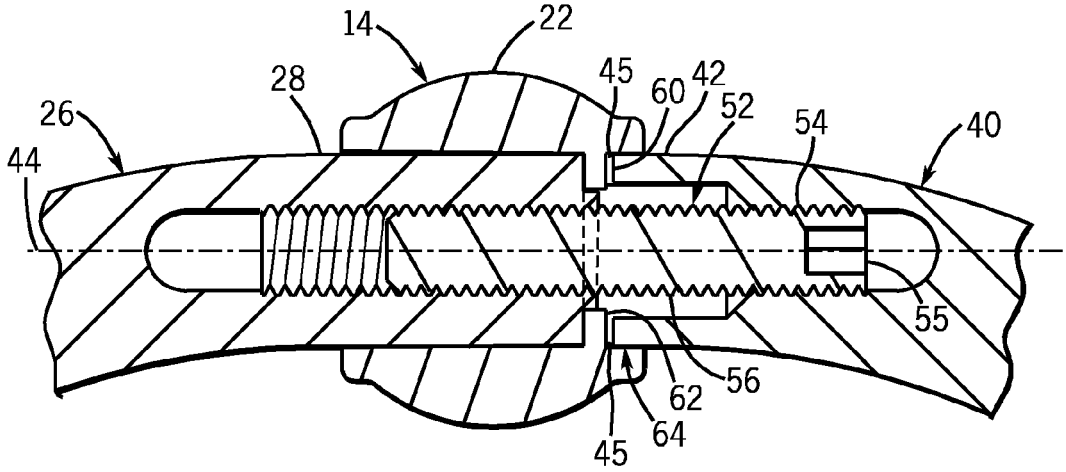
FIG. 7 is a partial section view along line 7-7 of FIG. 1.

The pivot arm 40 is preferably substantially self-supporting in the opened position. In the example embodiment, the pivot arm 40 includes components to maintain the pivot arm 40 in the raised position and to prevent the pivot arm 40 from making contact with and damaging the wall 12. Specifically, the pivot arm 40 of the example embodiment is restrained in the open or raised position by frictional engagement between various components. With reference to FIGS. 6 and 7, a threaded rod 52 extends from the mount head 22. As shown best in FIG. 7, the rod 52 is rotatably driven into a threaded hole 54 formed in the proximal end 28 of the support arm 26 by inserting a tool (not shown) into a keyway 55 formed in the threaded rod 52. An exposed portion 56 of the rod 52 is configured to extend into a threaded hole 58 formed in the proximal end 42 of the pivot arm 40. The engagement is such that as the pivot arm 40 is rotated about the pivot axis 44 as shown in FIG. 2, the engagement between the exposed portion 56 of the threaded rod 52 and the threaded hole 58 of the pivot arm 40 draws or translates the pivot arm 40 along the pivot axis 44 toward the mount head 22 to close the gap 45 shown in FIG. 7.

The length of the exposed portion 56 that engages the threaded hole 58 formed in the pivot arm 40 is adjusted such that an engagement surface 60 of the pivot arm 40 cams or wedges against a bearing surface 62 of a recess 64 formed in the mount head 22. In operation, as the pivot arm 40 is rotated upward as shown in FIG. 2 to the raised position shown in FIG. 3, the pivot arm 40 is drawn along the pivot axis 44 until the engagement surface 60 abuts the bearing surface 62, effectively preventing the pivot arm 40 from hitting the wall 12. Also, the friction developed at the interface between the engagement surface 60 and the bearing surface 62 resists unintentional rotation of the pivot arm 40 toward the lowered, closed position shown in FIG. 1. As a result, the pivot arm 40 is essentially self-supporting in the raised position.

To maintain the desired frictional engagement throughout repeated use, the threaded rod 52 is configured such that the rod 52 will not rotate with respect to the support arm 26 as the pivot arm 40 rotates about the pivot axis 44. This can be accomplished in a variety of ways. For example, and as shown in the example embodiment, the engagement or fit between the threaded rod 52 and the threaded hole 54 may be very close such that rotation of the rod 52 in the threaded hole 54 formed in the support arm 26 requires more force than is generated by raising and lowering the pivot arm 40. Additionally, once the appropriate amount of exposed portion 56 is determined, an adhesive may be used to further prevent rotation of the rod 52.

One skilled in the art will appreciate the variety of constructions available to maintain the orientation of the pivot arm 40, either in the lowered position, the raised position, or any intermediate position. For example, a spring-loaded ball may be secured in the recess 64 and selectively extend into a series of detents in the engagement surface 60 of the pivot arm 40. The spring-loaded ball may be configured, for example, to selectively engage a detent in the lowered position and another detent in the raised position.

In the example embodiment, the support arm 26 is press fit into and/or secured with adhesive to the mount head 22. Alternatively, the support arm 26 may be coupled to the mount head 22 to be pivotable about the pivot axis 44, however, the range of rotation of the support arm 26 is preferably substantially less than that of the pivot arm 40. If the support arm 26 is allowed to pivot too far, the replacement of a spent consumable roll 38 becomes more difficult. One skilled in the art will appreciate the numerous alternative constructions that are within the scope of the present invention.

In an alternative construction, the roll holder 10 may be configured such that the spindle 31 is secured to the pivot arm 40. As a result, the pocket 50 may be oriented in the support head 27 of the support arm 26 to allow the spindle 31 to pivot with the pivot arm 40. Moreover, one skilled in the art will appreciate the various mounting orientations available for the roll holder 10.

The support arm 26, spindle 31, and pivot arm 40 are preferably cylindrical as shown in FIG. 1; however, each may take on a variety of other cross-sections and shapes. For example, the spindle 31 may be rectangular in cross-section to engage a matching opening formed in a consumable roll 38.

With further reference to FIG. 1, the roll holder 10 is preferably substantially symmetric about an essentially vertical plane that extends along the surface mount 14 and is substantially perpendicular to pivot axis 44 and/or the spindle axis 36. This provides a balanced aesthetic appearance and reduced moment arm available to torque the surface mount 14. In addition, the distance from the proximal end 28 to the distal end 30 of the support arm 26 is essentially equal to the distance from the proximal end 42 to the distal end 46 of the pivot arm 40. The distances may be measured either along the support arm 26 and pivot arm 40, or from the mount head 22 to the respective support head 27 and pivot head 41.

The components of the roll holder 10 may be made of a variety of suitable materials that are generally known to those having ordinary skill in the art. For example, the roll holder 10 may be mainly metallic or may comprise a plastic core coated or plated with a metal or other suitable finish.

A preferred example embodiment of the present invention has been described in considerable detail. Many modifications and variations of the preferred example embodiment described will be apparent to a person of ordinary skill in the art. Therefore, the invention should not be limited to the example embodiment described.

INDUSTRIAL APPLICABILITY

The invention provides a consumable roll holder for holding rolls that allows for easy replacement of spent rolls.

We claim:

1. A consumable roll holder, comprising:

a surface mount defining a pivot axis and having a bearing surface transverse to the pivot axis;

a support arm having a proximal end and a distal end, wherein the proximal end is coupled to the surface mount;

a spindle having a first end and a second end, wherein the first end of the spindle is coupled to the distal end of the support arm; and a pivot arm having an engagement surface transverse to the pivot axis, and a proximal end and a distal end, wherein the proximal end is pivotally coupled to the surface mount;

wherein a first distance from the proximal end to the distal end of the support arm is essentially equal to a second distance from the proximal end to the distal end of the pivot arm; and wherein rotation of the pivot arm about the pivot axis is inhibited by engagement between the bearing surface and the engagement surface when the pivot arm is in an opened position, at which the distal end of the pivot arm is spaced apart from the second end of the spindle.

2. The holder of claim 1, wherein the support arm and the pivot arm are essentially symmetric about the surface mount.

3. The holder of claim 1, wherein the distal end of the pivot arm captures the second end of the spindle when in a closed position at which the distal end of the pivot arm is proximate the second end of the spindle.

4. The holder of claim 1, further comprising:

a spindle axis defined by the first end and the second end of the spindle;

wherein the pivot arm pivots about the pivot axis that is essentially parallel to the spindle axis; and wherein the proximal end of the support arm is fixed to the surface mount.

5. A consumable roll holder mountable to a surface, comprising:

an escutcheon adjacent the surface;

a surface mount extending from the escutcheon and having a mount head;

a support arm having a proximal end and a distal end, wherein the proximal end is coupled to the mount head;

a pivot arm having a proximal end and a distal end, wherein the proximal end is pivotally coupled to the mount head to be rotatable between a closed position and an opened position; and a spindle having a first end and a second end defining a spindle axis, wherein the first end of the spindle is coupled to the distal end of one of the support arm and the pivot arm;

wherein the support arm and the pivot arm are substantially symmetric about a plane passing through the mount head and substantially perpendicular to the spindle axis; and wherein the pivot arm pivots about an axis essentially parallel to the spindle axis.

6. The roll holder of claim 5, wherein the first end of the spindle is attached to the distal end of the support arm.

7. The holder of claim 6, wherein the second end of the pivot arm includes a pocket that at least partially captures the second end of the spindle when in the closed position.

8. The holder of claim 5, wherein the support arm is fixed to the mount head.

9. The roll holder of claim 5, wherein the first end of the spindle is attached to the distal end of the pivot arm.

10. The roll holder of claim 5, wherein a first distance from the mount head to the distal end of the support arm is essentially equal to a second distance from the mount head to the distal end of the pivot arm.

11. The holder of claim 5, wherein when the pivot arm is in the opened position it is inhibited from rotating toward the closed position.

12. The holder of claim 11, wherein the pivot arm is inhibited by a frictional engagement between the pivot arm and the surface mount.

13. The holder of claim 12, further comprising:

a threaded rod extending from the mount head; and a threaded hole formed in the proximal end of the pivot arm for engaging the rod;

wherein rotation of the pivot arm about the threaded rod toward the opened position causes the pivot arm to translate along the threaded rod and engage the mount head.

14. A consumable roll holder, comprising:

a surface mount defining a pivot axis;

a support arm extending away from the surface mount along the pivot axis;

a spindle extending proximate a distal end of the support arm and defining a spindle axis; and a pivot arm extending away from the surface mount along the pivot axis and pivotally coupled to the surface mount such that the pivot arm can rotate between a closed position whereat the pivot arm is proximate the spindle and an opened position whereat the pivot arm is spaced apart from the spindle;

wherein the support arm and the pivot arm are essentially symmetric about a plane passing through the surface mount and substantially perpendicular to the spindle axis; and wherein the pivot arm rotates about an axis essentially parallel to the spindle axis.

15. The holder of claim 14, wherein the pivot arm includes a pocket that is adjacent the distal end of the spindle when the pivot arm is in the closed position.

16. The holder of claim 14, wherein the pivot arm is inhibited from rotation when in the opened position.

17. The holder of claim 16, wherein the pivot arm is inhibited by a frictional engagement between the pivot arm and the surface mount.

18. A consumable roll holder, comprising:

a surface mount defining a pivot axis;

a support arm extending away from the surface mount along the pivot axis and having a proximal end and a distal end, wherein the proximal end is coupled to the surface mount;

a spindle having a first end and a second end, wherein the first end of the spindle is coupled to the distal end of the support arm;

a pivot arm extending away from the surface mount along the pivot axis and having a proximal end and a distal end, wherein the proximal end is pivotally coupled to the surface mount; and a spindle axis defined by the first end and the second end of the spindle;

wherein a first distance from the proximal end to the distal end of the support arm is essentially equal to a second distance from the proximal end to the distal end of the pivot arm;

wherein the pivot arm pivots about a pivot axis that is essentially parallel to the spindle axis; and wherein the proximal end of the support arm is fixed to the surface mount.

19. A consumable roll holder mountable to a surface, comprising:

an escutcheon adjacent the surface;

a surface mount extending from the escutcheon and having a mount head;

a support arm having a proximal end and a distal end, wherein the proximal end is coupled to the mount head;

a pivot arm having a proximal end and a distal end, wherein the proximal end is pivotally coupled to the mount head to be rotatable between a closed position and an opened position; and a spindle having a first end and a second end defining a spindle axis, wherein the first end of the spindle is coupled to the distal end of one of the support arm and the pivot arm;

wherein the support arm and the pivot arm are substantially symmetric about a plane passing through the mount head and substantially perpendicular to the spindle axis; and wherein when the pivot arm is in the opened position it is inhibited from rotating toward the closed position.

20. A consumable roll holder, comprising:

a surface mount defining a pivot axis;

a support arm extending from the surface mount;

a spindle extending proximate a distal end of the support arm and defining a spindle axis; and a pivot arm extending from the surface mount and pivotally coupled to the surface mount such that the pivot arm can rotate between a closed position whereat the pivot arm is proximate the spindle and an opened position whereat the pivot arm is spaced apart from the spindle;

wherein the support arm and the pivot arm are essentially symmetric about a plane passing through the surface mount and substantially perpendicular to the spindle axis; and wherein the pivot arm translates along the pivot axis as the pivot arm rotates toward the opened position to inhibit rotation of the pivot arm when in the opened position.

* * * * *